US005094050A

United States Patent [19]

Jenkins

[11] Patent Number: 5,094,050

[45] Date of Patent: Mar. 10, 1992

[54] OPENABLE CHIMNEY CAP AND FLUE DAMPER

[76] Inventor: James H. Jenkins, 6010 N. 26th St., Arlington, Va. 22207

[21] Appl. No.: 645,742

[22] Filed: Jan. 25, 1991

[51] Int. Cl.[5] ..... F23L 17/10

[52] U.S. Cl. ..... 52/218; 454/4; 454/12

[58] Field of Search ..... 52/218, 219; 126/286; 98/59, 67

[56] References Cited

U.S. PATENT DOCUMENTS

| | | | |
|---|---|---|---|
| 2,295,839 | 9/1942 | Grigsby | 98/59 |
| 3,101,039 | 8/1963 | Duchene et al. | 98/59 |
| 4,020,754 | 5/1977 | Dalsin et al. | 98/59 |

FOREIGN PATENT DOCUMENTS

| | | | |
|---|---|---|---|
| 1344498 | 1/1974 | United Kingdom | 126/286 |

*Primary Examiner*—Richard E. Chilcot, Jr.
*Assistant Examiner*—Wynn Wood

[57] ABSTRACT

A chimney cap and flue damper supported for vertical movement on the upper end of a chimney liner with an operating cable extending downwardly to the fireplace opening to effect opening and closing movement of a hollow insulation filled sheet metal closure member. The cap is supported by a support assembly having a plurality of radially expandable turnbuckles which are anchored in sockets formed in the chimney liner. The operating cable is provided with a removable weight which is sufficient to overcome a spring which holds the closure member in open position.

6 Claims, 3 Drawing Sheets

OPENABLE CHIMNEY CAP AND FLUE DAMPER

BACKGROUND OF THE INVENTION

1. Field of the Invention

The present invention generally relates to a chimney cap and flue damper mounted on the top of a chimney and operable from the interior of a fireplace. The cap is a hollow insulated member which sealingly contacts the upper end of the chimney or flue liner to prevent heat loss and entry of rain, birds and other animals. The cap is supported by diagonal members expanded into the flue liner and telescopic spring biased tubes which bias the cap to open position. A cable extends downwardly to the fireplace and is provided with a loop from which a weight can be suspended to keep the cap in closed position.

2. Description of the Prior Art

Most fireplaces are provided with a damper which is located at the lower end of the chimney and is manually operated when the fireplace is to be used. Also chimney caps are known which are supported in upwardly spaced relation to the upper end of the chimney. While such devices perform in the manner intended, they do not effectively close the chimney to prevent loss of heated air and existing dampers do not stop birds, animals and the like from entering the chimney. The prior art does not include a cap which sealingly engages the upper end of a chimney and which can be opened or closed from the interior of the fireplace.

SUMMARY OF THE INVENTION.

An object of the present invention is to provide a chimney cap which sealingly engages the upper end of a chimney liner and is mounted for vertical movement between open and closed positions from the interior of the fireplace.

Another object of the invention is to provide a chimney cap in accordance with the preceding object in which the cap is a hollow insulated member and is supported by a pair of telescopic tubes with the outer tube being supported by radially expandable screw threaded members which engage the corners of the flue liner.

A further object of the invention is to provide a chimney cap as defined in the preceding objects in which the telescopic tubes are spring biased apart to move the cap to open position with a cable extending downwardly to the fireplace and provided with a detachable weight to hold the cap in closed position.

These together with other objects and advantages which will subsequently become apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
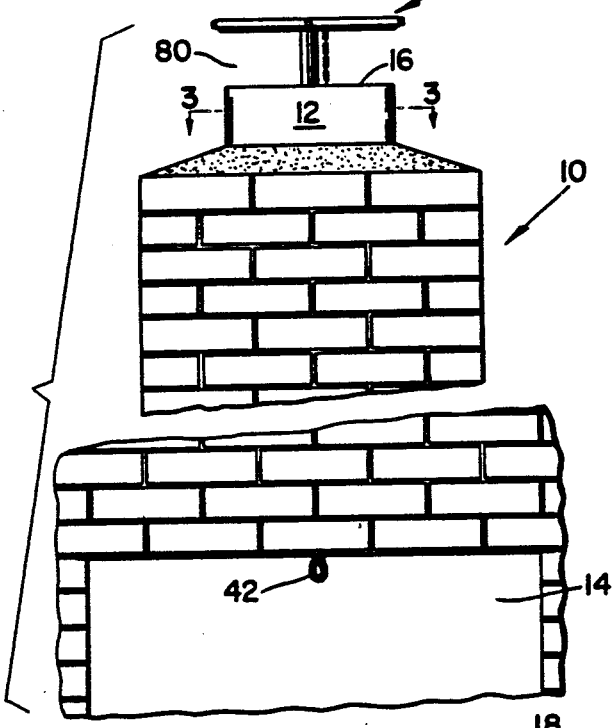
FIG. 1 is a side elevational view of a chimney cap of this invention in open position.
Figure 2:
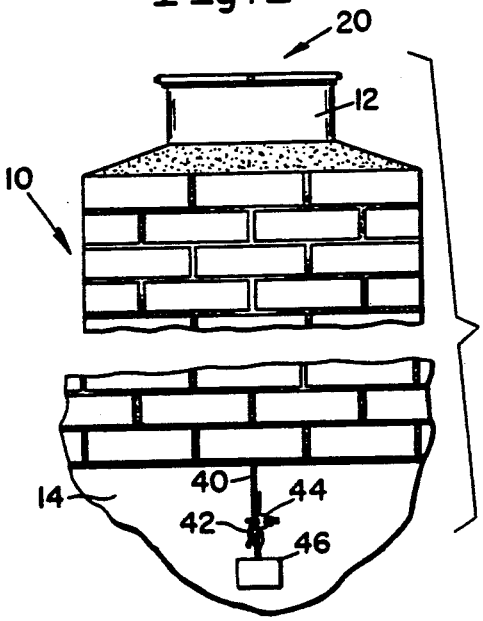
FIG. 2 is a similar view with the cap open.
Figure 3:
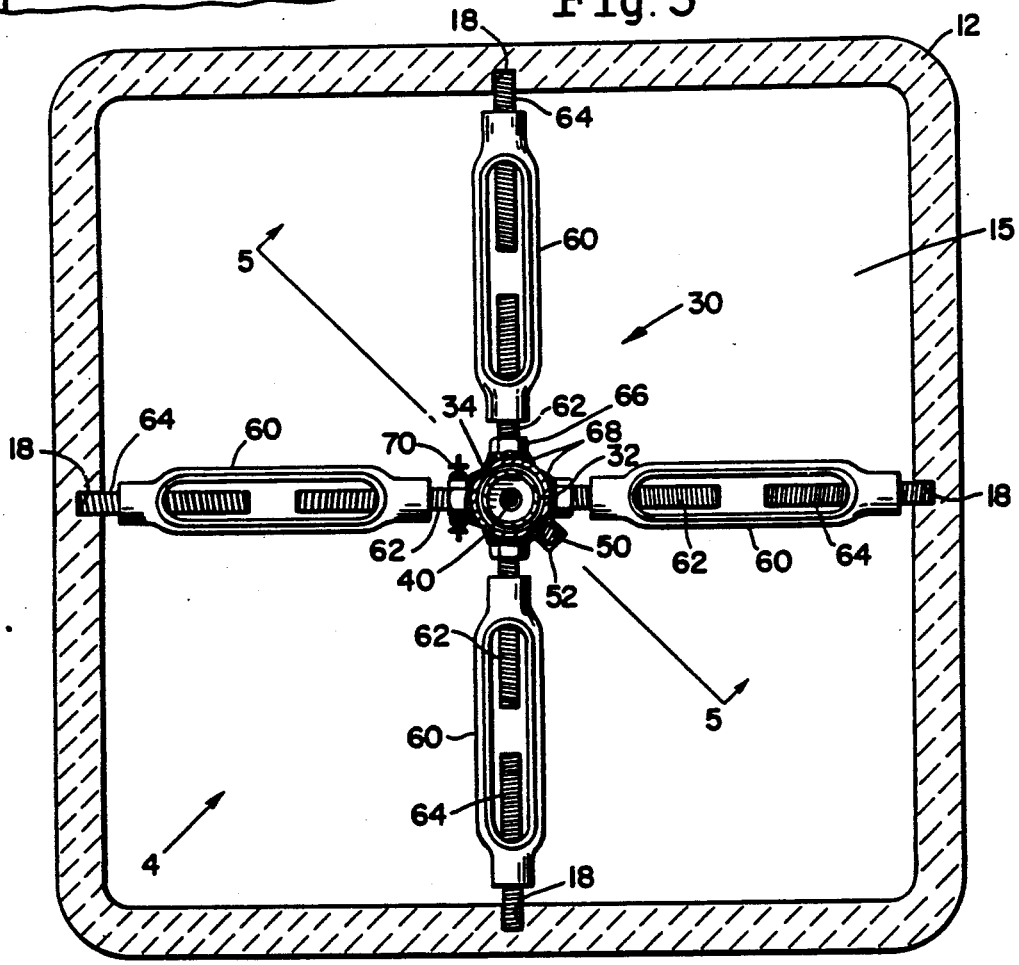
FIG. 3 is a plan sectional view taken along section line 3—3 on FIG. 1 on an enlarged scale.

Referring to the drawings, the chimney cap of this invention is generally referred to by reference numeral 20 and is mounted on top of chimney 10 by engaging chimney liner 12. A conventional fireplace 14 is shown at the bottom of the chimney and the upper end of the liner 12 extends above the chimney 10 as indicated by reference numeral 16. The liner is also provided with drilled holes 18 in the inner corners to support the cap or damper 20 in a manner set forth hereinafter.

The cap 20 includes a top pan shaped member 22 and a bottom pan shaped member 24 which have their flanges telescoped and secured together by screws 27 with the hollow interior of the cap being filled with insulation 26. The bottom surface of the cap 20 is provided with a fire resistant seal 28 which sealingly engages the top edge of the liner 12 when the cap is in lowered or closed position.

Figure 4:
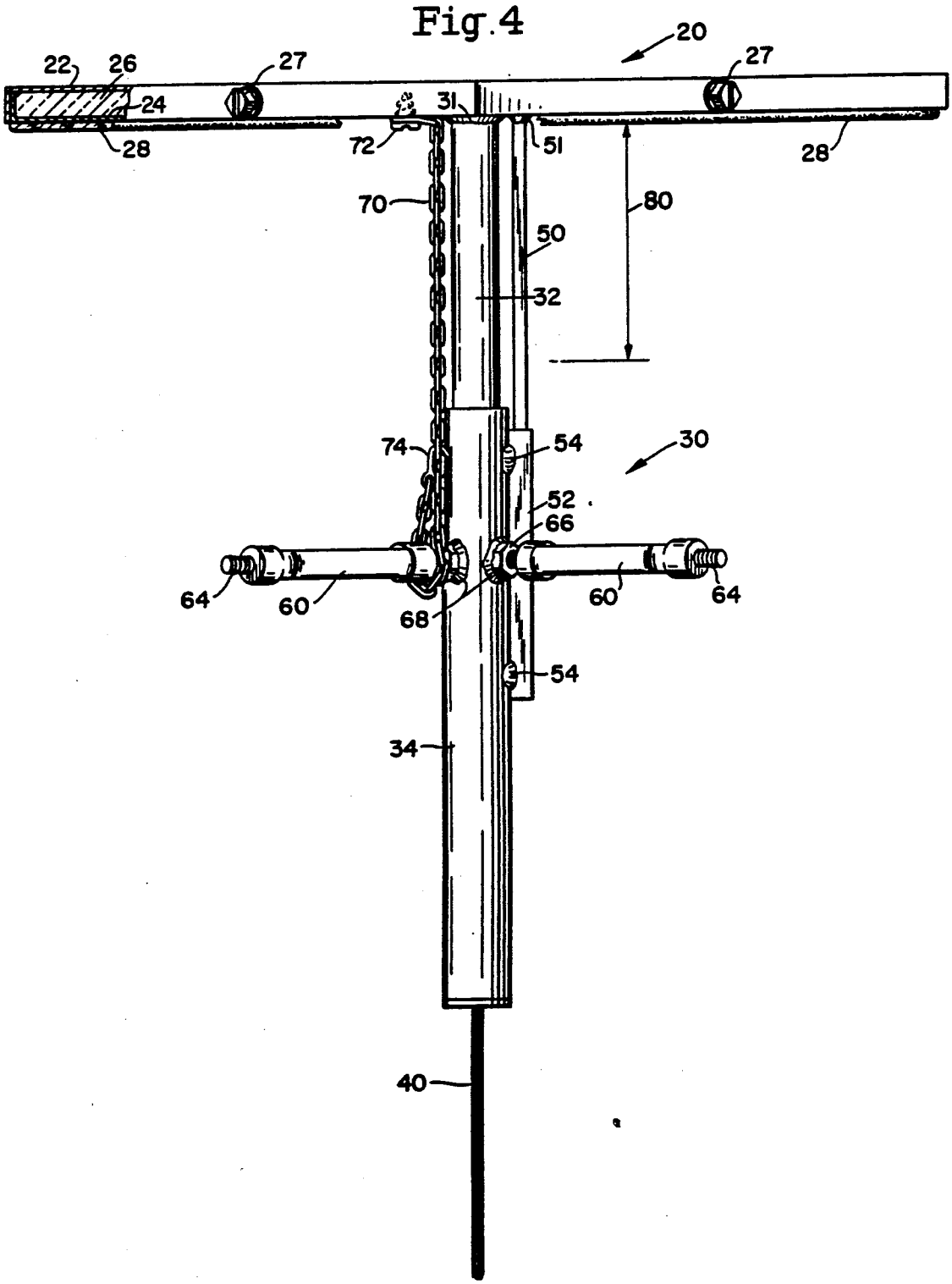
FIG. 4 is a side elevational view of the invention taken in the direction of arrow 4 in FIG. 3.
Figure 5:
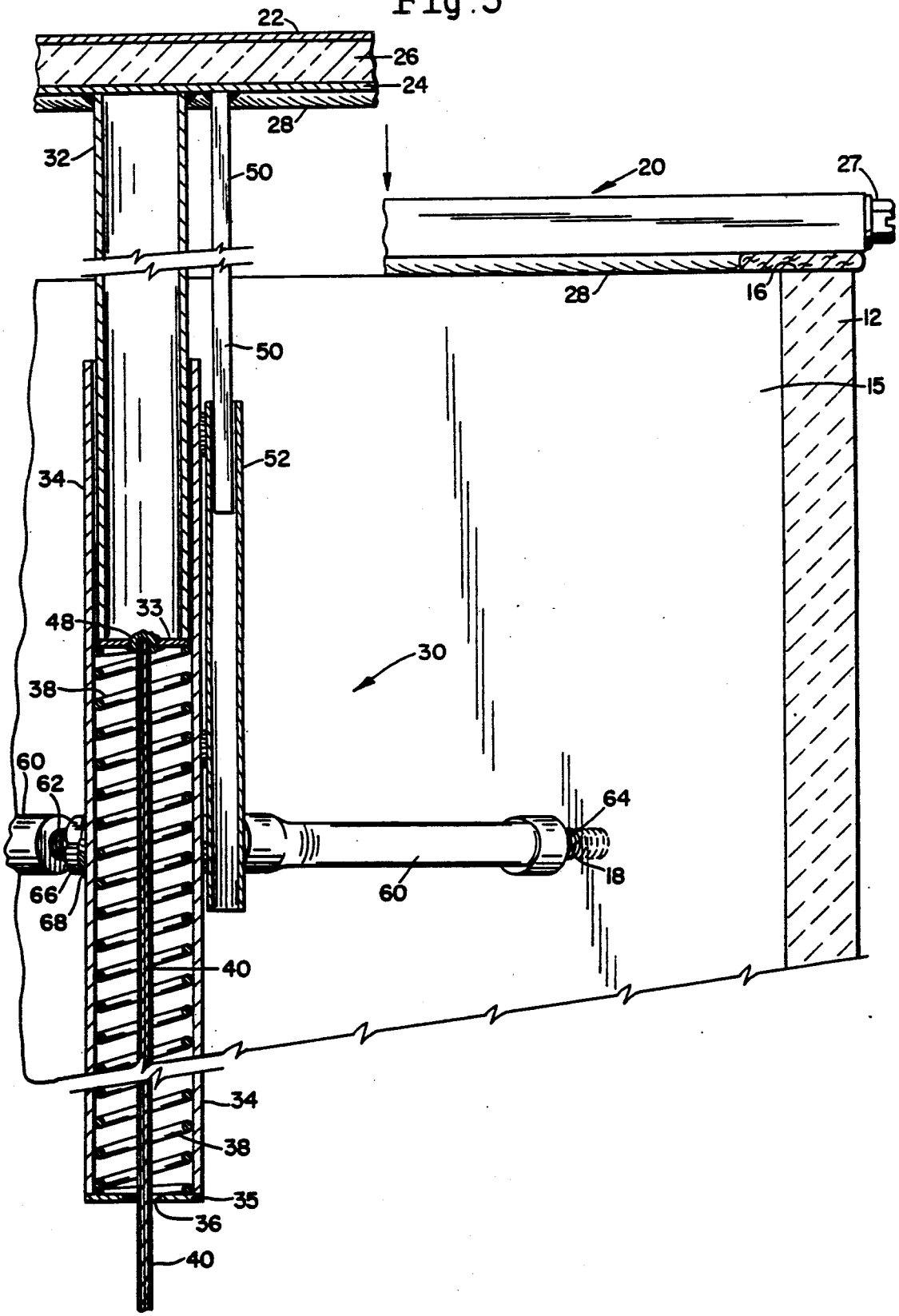
FIG. 5 is a vertical sectional view, on an enlarged scale, taken along section line 5—5 on FIG. 3 with the right hand portion showing the cap in closed position.

The cap 20 is supported from the chimney liner 12 by a support assembly 30 which includes a depending support tube 32 welded to the center of the bottom pan 24 at 31. The lower end of the tube 32 is closed by a washer 33 welded to the tube 32. An outer support tube 34 telescopes over tube 32 and includes a bottom washer 35 welded thereto with washer 35 having an aperture 36 therein. A coil compression spring 38 is positioned in tube 34 and engages the washers 33 and 35 and biases the tubes 32 and 34 apart. A cable 40 extends through aperture 36 and has one end welded to the washer 33 at 48. The other end of the cable 40 extends into the fireplace opening 14 and is provided with a loop 42 formed by a cable clamp 44 with the loop 42 removably supporting a weight 46 which is of sufficient mass to compress the spring 38 when suspended from the cable 40. To prevent the tubes 32 and 34 from rotating in relation to each other, a square rod 50 is welded to the cap 20 and a square tube 52 is welded to tube 34 with the welds being designated by reference numerals 51 and 54 as shown in FIG. 4. This structure permits telescopic movement but prevents the tubes from rotating.

The outer tube 34 is supported by four radially extending turnbuckles 60 each of which includes an inner screw 62 and an outer screw 64. The inner end of screw 62 is anchored to the tube 34 by a hex nut 66 rigid with screw 62 and welded to tube 34 at 68. The outer end of screw 64 is anchored in holes or sockets 18 in liner 12 in order to expand the turnbuckle 60 when the center portion is rotated thereby rigidly mounting the supporting assembly 30 in the liner 12.

A chain 70 is connected to the bottom pan 24 by a screw 72 and the lower end of the chain is wrapped around inner screw 62 of one of the turnbuckles and the end of the chain 70 is adjustably connected to the vertical portion of the chain by a hook 74 in order to limit the upward movement of the cap 20 thus retaining the tubes and guide in telescopic relation.

When the cap 20 is closed, rain cannot enter the chimney which can cause the existing fireplace damper and firebox to rust in the event the firebox is metal. This also prevents birds from entering the chimney and building nests which could cause blockage of the chimney.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A chimney cap and flue damper comprising a rigid closure member having a downwardly facing surface adapted to sealingly associate with the upper end of a chimney, means depending from said member adapted to engage the interior of the chimney to support said member for vertical movement between open and closed positions, and means depending from said member to a fireplace opening in the chimney to effect movement of said member to said open and closed positions, said support means including a pair of telescopic tubes including an upper tube secured to said member and a lower tube spring-biased downwardly from said member, said lower tube including four radially extending anchoring turnbuckles having outer ends secured in recesses in a chimney liner to rigidly mount the tubes in the chimney, said member being a hollow sheet metal member formed by a pair of shallow pan-shaped sheet metal members having telescoping flanges secured together by fasteners, the interior of said hollow member being filled with insulating material.

2. The chimney cap as defined in claim 1 wherein said means to effect movement includes an elongated flexible member attached to the upper tube and descending through the lower tube to the fireplace opening, and a weight sufficient to overcome said spring bias detachably supported from the lower end of said flexible member to move said closure member downwardly to closed position with removal of the weight enabling the closure member to move to open position.

3. The chimney cap as defined in claim 2 wherein said telescopic tubes are provided with telescopic guide means to prevent the tubes from rotating in relation to each other.

4. The chimney cap as defined in claim 3 wherein an adjustable length flexible member interconnects said closure member and one of said turnbuckles to limit the upward movement of the closure member toward open position.

5. The chimney cap as defined in claim 4 wherein said depending flexible member is a cable welded to the lower end of the upper tube, said lower tube including a coil spring positioned between a lower closed end on the upper tube and a washer on the lower end of the lower tube, said cable extending through said washer, said adjustable length member being a chain having one attached to said closure member and the other end wrapped around said one turnbuckle with the terminal end provided with a hook to engage a selected link in the chain to vary the effective length thereof.

6. A chimney cap and flue damper comprising a rigid closure member having a downwardly facing surface adapted to sealingly associated with the upper end of a chimney, means depending from said member adapted to engage the interior of the chimney to support said member for vertical movement between open and closed positions, and means depending from said member to a fireplace opening in the chimney to effect movement of said member to said open and closed positions, said support means including a pair of telescopic tubes including an upper tube secured to said member and a lower tube spring-biased downwardly from said member, said lower tube including a plurality of radially expandable anchoring turnbuckles having outer ends secured in recesses in a chimney liner to rigidly mount the tubes in the chimney, said depending means including a cable welded to the lower end of the upper tube, said lower tube including a coil spring positioned between a lower closed end on the upper tube and a washer on the lower end of the lower tube said cable extending through said washer, a chain having an upper end attached to said closure member and the lower end connected with said lower tube to limit movement of said closure member toward the open position.

* * * * *